US007938262B1

(12) United States Patent
Havive et al.

(10) Patent No.: US 7,938,262 B1
(45) Date of Patent: May 10, 2011

(54) POTPOURRI HOLDER

(75) Inventors: Rony Havive, Oak Park, CA (US); Amy Wagner, Camarillo, CA (US)

(73) Assignee: MGR Design International, Oak Park, CA (US)

( * ) Notice: Subject to any disclaimer, the term of this patent is extended or adjusted under 35 U.S.C. 154(b) by 0 days.

(21) Appl. No.: 12/962,432

(22) Filed: Dec. 7, 2010

Related U.S. Application Data

(60) Provisional application No. 61/282,779, filed on Mar. 31, 2010, provisional application No. 61/282,821, filed on Apr. 7, 2010, provisional application No. 61/282,925, filed on Apr. 23, 2010, provisional application No. 61/344,400, filed on Jul. 14, 2010, provisional application No. 61/344,349, filed on Jul. 2, 2010.

(51) Int. Cl.
*B65D 85/52* (2006.01)

(52) U.S. Cl. ..... 206/423; 206/457; 220/485

(58) Field of Classification Search ..... 206/532, 206/457, 575, 423; 220/485, 486, 491, 495
See application file for complete search history.

(56) References Cited

U.S. PATENT DOCUMENTS

| | | | | | |
|---|---|---|---|---|---|
| 1,499,665 | A * | 7/1924 | Kaufman | 220/485 |
| 2,367,448 | A * | 1/1945 | Thiele | 99/409 |
| 2,456,419 | A * | 12/1948 | Jackson et al. | 220/6 |
| 2,575,149 | A * | 11/1951 | Watson | 220/4.21 |
| 2,632,578 | A * | 3/1953 | Brickman | 220/6 |
| 3,419,175 | A * | 12/1968 | Laughlin et al. | 220/486 |
| 3,874,547 | A * | 4/1975 | Howard | 220/485 |
| 4,300,697 | A * | 11/1981 | Dickens | 220/486 |
| 4,836,392 | A * | 6/1989 | Constantino | 211/133.5 |
| D356,149 | S * | 3/1995 | Tatman et al. | D23/367 |
| D379,651 | S * | 6/1997 | Rondeau | D23/367 |
| 6,237,788 | B1 * | 5/2001 | Shuen | 215/12.1 |

* cited by examiner

*Primary Examiner* — Jacob K Ackun, Jr.
(74) *Attorney, Agent, or Firm* — Cislo & Thomas, LLP

(57) ABSTRACT

A decorative holder for holding potpourri or decorative items having hinged opening at the top, side, or bottom, the hinged opening capable of being secured closed, for example, by a latch or hook and loop closure, and capable of holding materials therein. The framed holder is formed by a plurality of frame supports that form a base and a lid and side frame supports and simulating the shape of one or more natural products such as a fruit, vegetable, nut, seed, animal, reptile, sea creature, star, or ball, box, or other similar object. The plurality of frame supports may further include a framework that is woven in and about the holder to secure the decorative items. The materials to be secured in the holder may include decorative items; botanicals, natural and/or synthetic; food stuffs; personal effects; and the like, all having a size and shape larger than any aperture in the holder.

20 Claims, 12 Drawing Sheets

POTPOURRI HOLDER

CROSS-REFERENCES TO RELATED APPLICATIONS

This patent application claims the benefit of U.S. Provisional Patent Application Ser. No. 61/282,779 filed Mar. 31, 2010 for "Wire frame botanical wreaths, made of metal or plastic with or without fragrance. Back side with nob latches few locks and hangers." U.S. Provisional Patent Application Ser. No. 61/282,821 filed Apr. 7, 2010 for "Wire frame botanical wreaths, made of metal or plastic with or without fragrance. Shaped for example as acorns, pumpkins, apples, pears, etc. with few nobs latches locks and stands," U.S. Provisional Patent Application Ser. No. 61/282,925 filed Apr. 23, 2010 for "Wire frame botanical urns, orbs, and lamps made of metal and plastic with or without fragrance shaped as urns, orbs, lamps, with few nobs, latches, locks and stands," U.S. Provisional Patent Application Ser. No. 61/344,400 filed Jul. 14, 2010 for "Wire frame cage botanical potpourri shaped as roll orbs urns lamps cube wreaths, made of metal and plastic with or without fragrance. The roll or cube have few holes acting as a dispenser with nobs, latches tops locks and stands," and U.S. Provisional Patent Application Ser. No. 61/344,349 filed Jul. 2, 2010 for "Wire frame botanical potpourri shaped as orbs urns lamps cylinders lamps wreaths, made of metal and or plastic, with or without fragrance. The orbs have a net of holes acting as a dispenser with nobs, latches, tops, locks, and stands," which applications are incorporated here by this reference.

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

TECHNICAL FIELD

This invention relates to framed holders having a hinged top, side, or bottom and latch closure for holding potpourri or other decorative items.

BACKGROUND ART

Vessels capable of holding decorative items for use in the home, office, stores, lodging facilities, or other places seeking to establish a comfortable, stylish environment are often poorly designed, flimsy, unable to securely contain decorative items when being displayed or moved, and displeasing to the eye. As a result, the decorative items such as potpourri with or without fragrance, botanicals, mirrored balls, real, dried, or synthetic fruit, or the like are often poorly displayed and very likely to spill or cause a mess when placed in a holder. Also, displaying such decorative items in an open container or in a loosely framed container can be hazardous to children and animals if eaten, or damaging to fine furnishings if spilled. Fragranced botanicals can be particularly damaging to furnishings and toxic to children and animals.

It can be very difficult to move decorative receptacles when their contents are precariously placed inside. A simple shift, bump, or change in location may be problematic and cause unnecessary, additional cleanup and work for a caretaker.

Storing and displaying decorative items that are messy and poorly presented can easily taint an environment and make it feel disorganized, ill-kempt, and uninviting.

In addition, many decorative items such as potpourri, botanicals, and the like, are sold in a bag or sold separately without a framed container, requiring purchasers to buy a separate display container. Buying such containers adds an extra step to being able to display decorative items, and it may be difficult to locate a container that safely and beautifully displays the items.

There is a need in the an for a receptacle capable of holding decorative items that securely holds such items in a beautiful, well-presented, and functional manner to enhance well-being, lift the aesthetics of an environment, and capture the eye while suiting the needs and tastes of a wide range of people and organizations. There is also a need in the art for a vessel sold in connection with decorative items to provide a complete product for containing and displaying the items.

DISCLOSURE OF INVENTION

The present invention relates to a decorative vessel shaped as a natural product selected from the group consisting of a fruit, vegetable, nut, seed, tree, animal, reptile, sea creature, or other object, for example, an object having a Thanksgiving theme, a winter holiday theme for Christmas, Hanukkah, and the New Year, or an ocean theme such as a wreath, star, lamp, or urn, with a hinged top, side, or bottom and closure fixed firmly to the body of the vessel capable of securely holding and displaying items. The decorative holder is shaped out of wire, metal, plastic, twigs, synthetic material, natural material, and/or combinations thereof.

The decorative holder can be shaped as any fruit, vegetable, nut, seed, tree, animal, reptile, sea creature, star, wreath, orb, urn, lamp, cylinder, including such objects as an acorn, pumpkin, apple, pear, and squash. Thanksgiving themed objects may include an acorn, pumpkin, apple, pear, and squash. Winter holiday themed vessels may include Christmas trees, reindeer, angels, decorative balls or orbs, stars, menorahs, candles, sleighs, presents, Santa Claus, bows; and ocean themed vessels may include shells, fish, sea horses, sea stars, and sand dollars. The hinged top, side, or bottom is capable of being secured to the body of the vessel with a latch, nob, or lock. The vessel can be placed directly on a surface or can be placed on a stand or hook and set upon a horizontal surface or attached to a vertical structure.

The decorative holder holds potpourri with or without fragrance, and other decorative items such as botanicals, mirrored balls, real, dried, or synthetic fruit, flowers, leaves, twigs, bark, bamboo, and seeds, metal shapes, and decoupage crafts. The potpourri can be real or artificial, including dried botanicals, fruit, plants, bark, twigs, leaves, and seeds. All of the decorative items are held within the frame of the holder and of a size and shape to be contained within the holder and of a greater size than any aperture in the holder. The decorative items can be easily seen within the decorative holder and can be easily smelled, if fragranced.

Also, the decorative holder can have additional framework woven on and about the holder to decrease the size of the apertures in the holder, the framework constructed of wire, metal, plastic, twigs, other synthetic material, or other natural material that is woven on and about the framed holder to add additional structure to secure the decorative items.

BEST MODE FOR CARRYING OUT THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
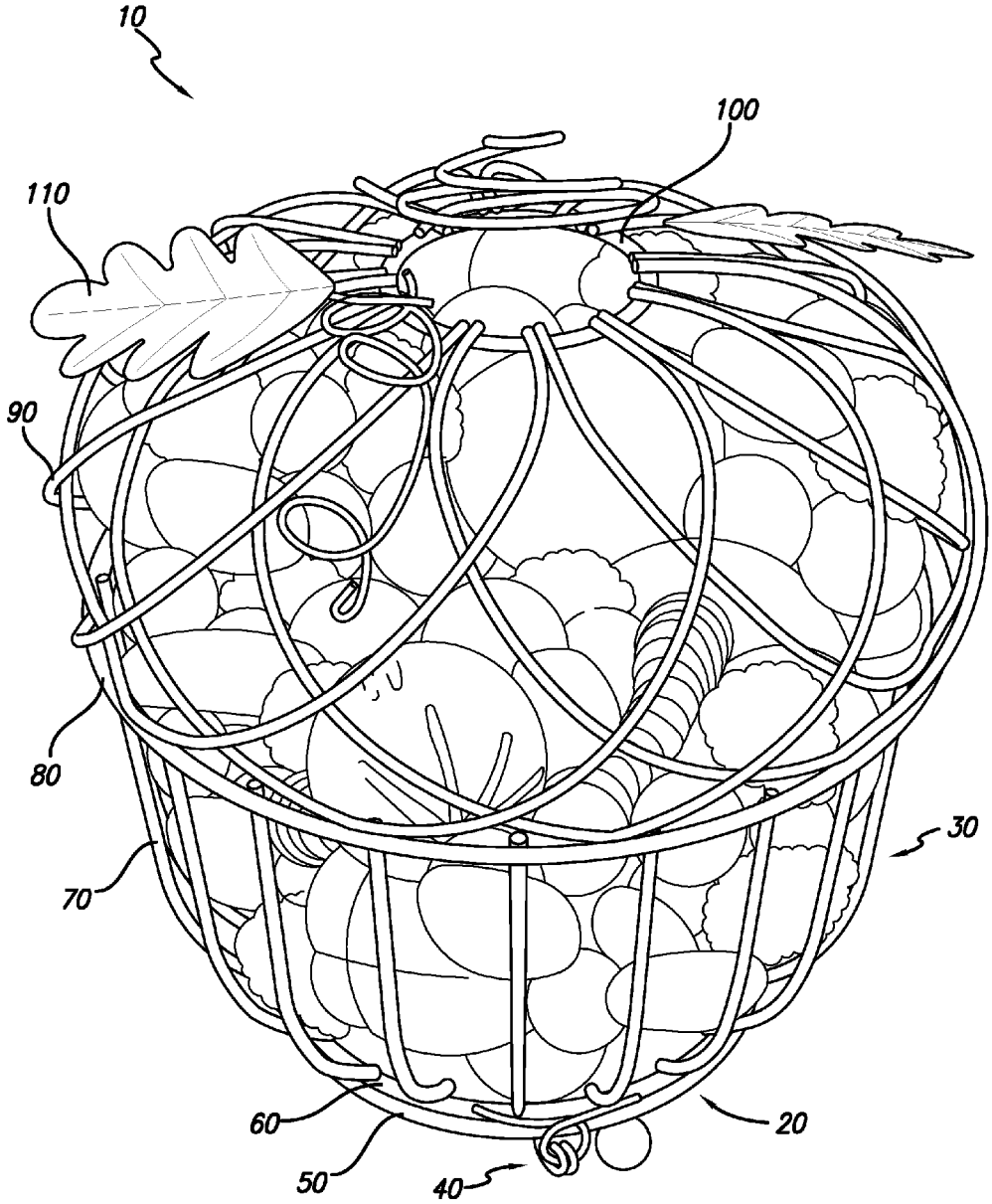
FIG. 1 is a perspective view of an embodiment of the inventive decorative holder for potpourri in the shape of an acorn.

FIG. 1 is a perspective view of an embodiment of the inventive decorative holder 10 showing a holder in the shape of an acorn. The framed holder in FIG. 1 depicts a vessel 10 comprising a base frame 20 connected to a lid frame 30 by a hinge (not shown) and a latch closure 40, the base frame 20 comprising a first support frame 50, the first support frame 50 of the base 20 connected to the lid by the hinge (not shown) and the latch closure 40, the lid 30 comprising a second support frame 60 that rests next to and the first support frame 50 of the base 20, the area defined by the second support frame 60 the same size as the area defined by the first support frame 50, the second support frame 60 connected to a plurality of side support frames 70 extending from the second support frame 50 up to meet together at a third support frame 80, the third support frame 80 connected to a plurality of top support frames 90, the top support frames 90, bent and shaped to meet at an apex 100 of the framed holder 10, the apex 100 having shaped objects 110 attached thereto, wherein the base frame 20 and the lid frame 30 of the framed holder 10 may be secured closed when the latch closure 40 is engaged, and wherein the base frame 20 and the lid frame 30 of the framed holder 10 may be opened to receive objects therein when the latch closure 40 is released and the hinge is bent open. The inventive framed holder described herein is constructed of metal, plastic, twigs, synthetic material, naturally occurring material, and combinations thereof. As shown, the plurality of side support frames 70 and the plurality of top support frames 90 are formed to simulate the shape of an acorn, but any other shape with a base and a lid having an opening at the base of the vessel is contemplated and may be simulated by the base frame and the lid frame, including a natural product selected from the group consisting of a fruit, vegetable, nut, seed, animal, reptile, sea creature, tree, and star, or other whimsical shapes such as a wreath, cylinder, orb, and urn. As shown, there are objects 110 at the apex 100 of the holder 10 are formed to simulate leaves, but may be any other naturally occurring or fabricated shape such as seeds, twigs, fruits, vegetables, orbs, cylinders, or other whimsical shapes. The objects 110 at the apex 100 may be of a size and shape smaller than the overall size of the inventive holder.

As shown in FIG. 1, the first support frame 50 and the second support frame 60 are circular in shape, but the first support frame 50 and the second support frame 60 may take on other shapes such as forming a shape having three or more sides. FIG. 1 depicts one embodiment of the inventive vessel having more than nine side support wires 70, however, the vessel may have more greater than five side support frames and five top support frames depending on the overall look desired and the need to contain certain shaped objects inside the container. For example, if larger objects will be placed into the inventive vessel, there may be less side support frames or if smaller objects will be placed into the inventive vessel, a large number of side support frames will be used. As such, objects can be securely stationed within the inventive holder 10 when the base 20 and the lid 30 are mated together and the latch closure 40 is engaged.

Also, the decorative holder contains decorative items such as potpourri 115 within the holder, the decorative items of a greater size than any aperture in the holder, thereby securing the decorative items in the container so they don't spill out. The apertures in the decorative holder are of a size and shape allowing the decorative items to be easily seen and smelled, if fragranced.

Figure 2:
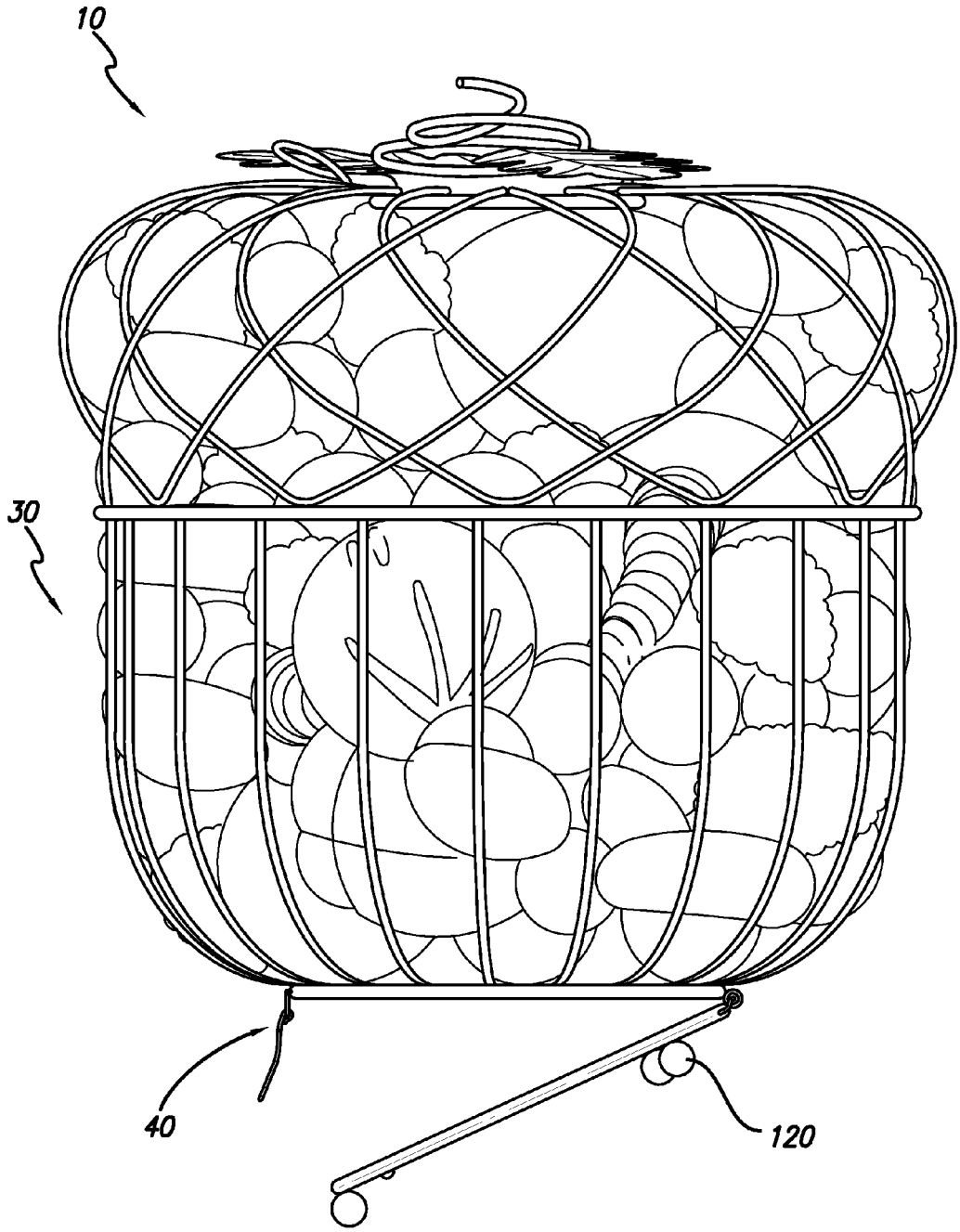
FIG. 2 is a perspective view of the embodiment of the inventive holder shown in FIG. 1 with the bottom open and the latch and hook closure open.

FIG. 2 is a perspective view of the embodiment of the inventive holder 10 shown in FIG. 1 with the top lid frame 30 open and the latch closure 40 open. Also shown are three or more feet 120 to support the base and provide points of contacts for the inventive holder 10 when resting on a surface.

Figure 3:
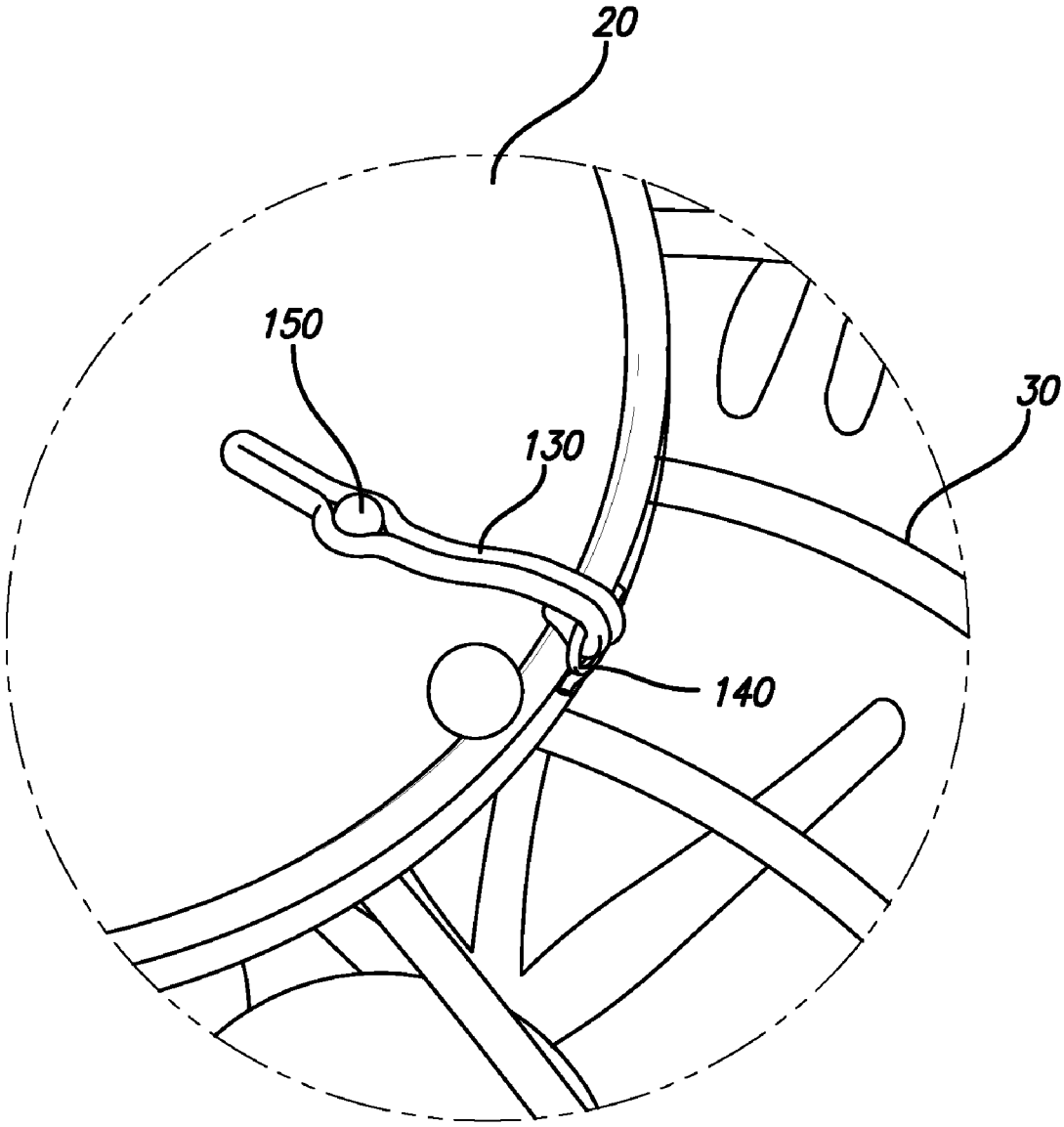
FIG. 3 is a close up view of the latch and hook closure on the acorn holder embodiment of the framed holder shown in FIG. 1.

FIG. 3 is a close up view of the latch closure on the acorn holder embodiment of the decorative holder 10 shown in FIG. 1, the latch closure in the closed position and showing a hook 130 anchored 150 to the base 20 and a loop 140 to receive the hook 130 in order to secure the base 20 to the lid 30.

Figure 4:
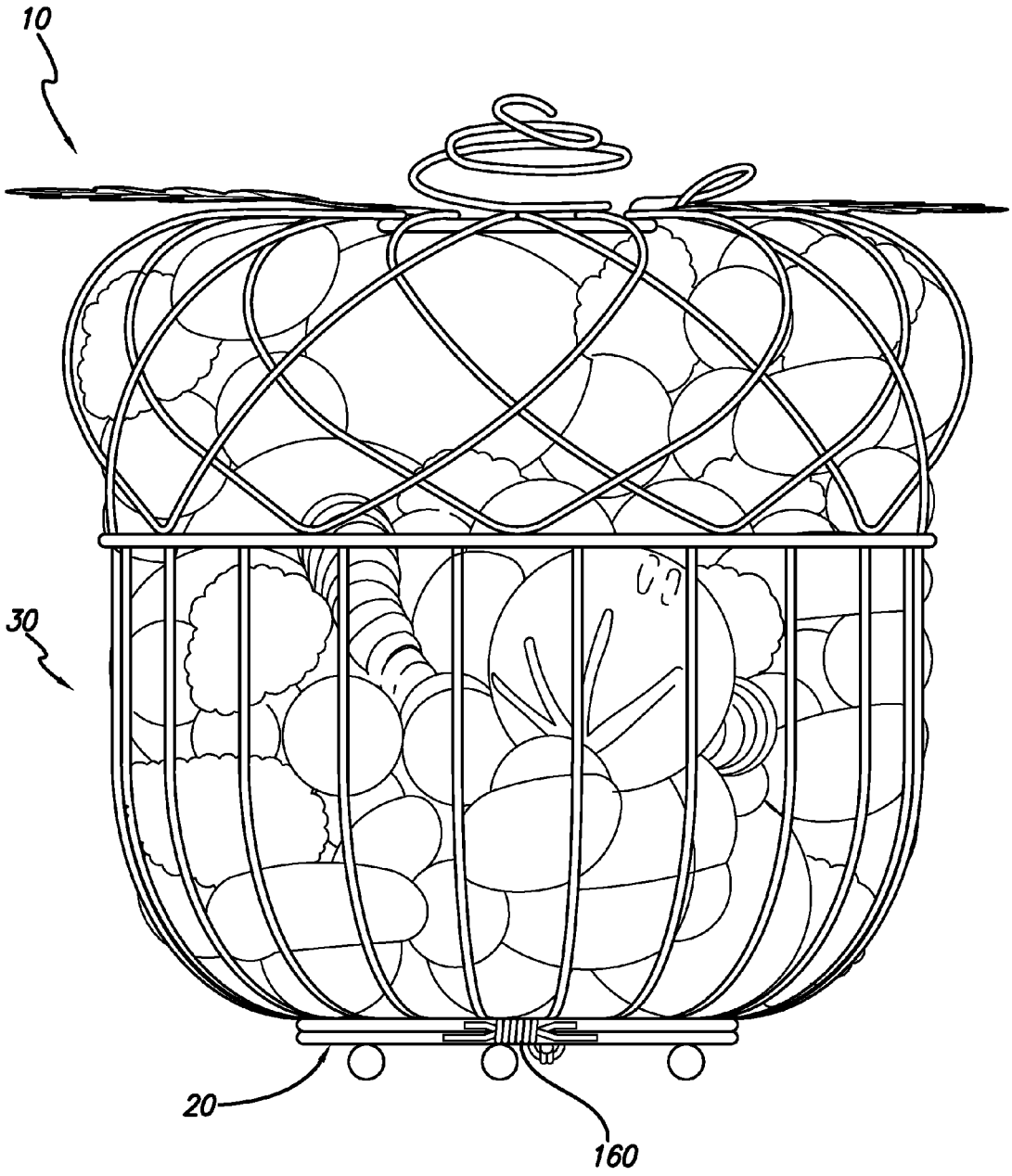
FIG. 4 is a rear view of the embodiment of the holder shown in FIG. 1 showing the hinge connecting the top with the bottom of the holder.

FIG. 4 is a rear view of the embodiment of the holder 10 shown in FIG. 1 showing the hinge 160 connecting the top lid 30 with the bottom base 20 of the holder 10.

Figure 5:
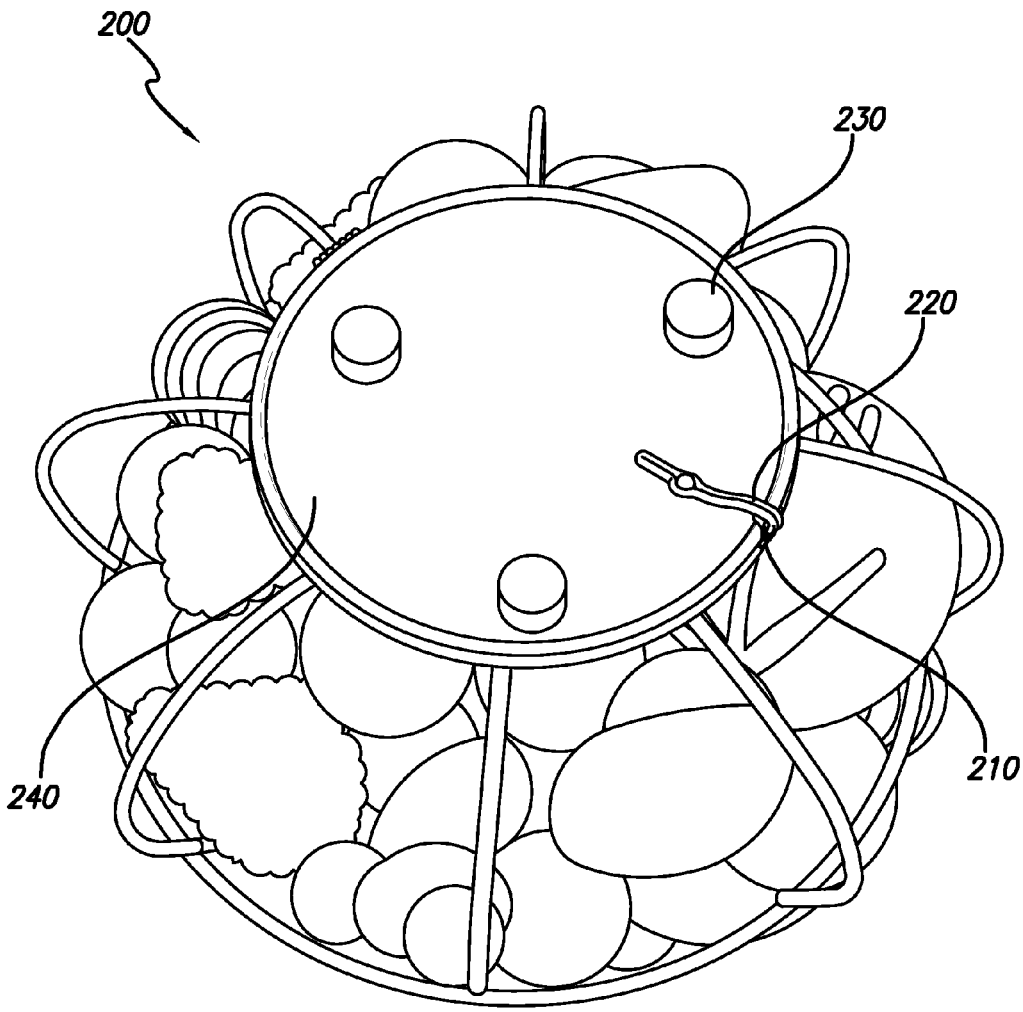
FIG. 5 is a bottom up view of an embodiment of the holder with a latch and hook closure on the bottom of the device.

FIG. 5 is a bottom up view of an embodiment of the holder 200 with a latch 210 and hook 220 closure on the bottom base 240 of the device 200. Also shown are three feet 230 to support the holder 200. The holder 200 may have no feet or it may have three or more feet 120.

Figure 6:
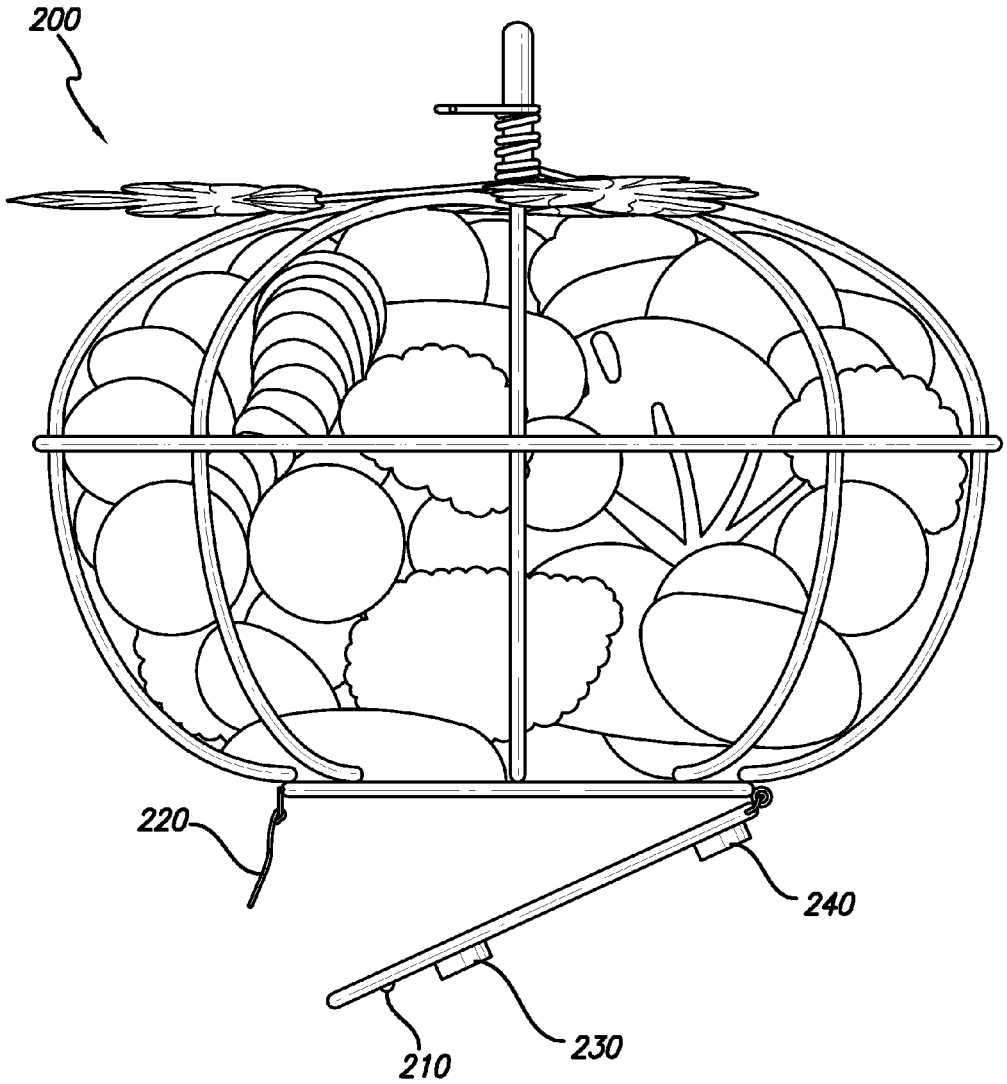
FIG. 6 is a view of the embodiment of the holder in the shape of a pumpkin with the bottom open and the latch and hook closure showing.

FIG. 6 is a view of the embodiment of the holder 200 shown in FIG. 5 with the bottom base 240 open and the latch 210 and hook 220 closure showing.

Figure 7:
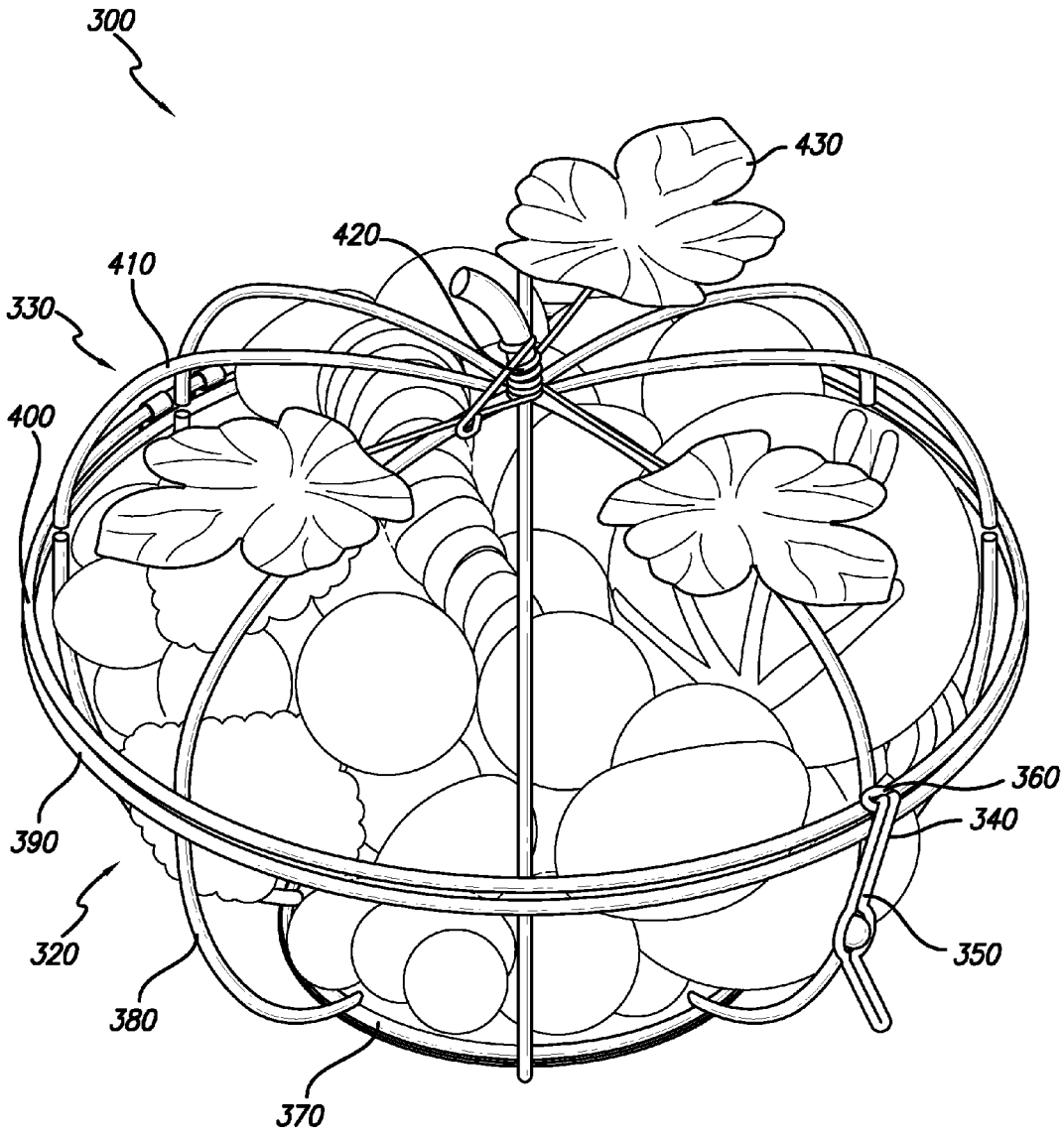
FIG. 7 is a perspective view of an embodiment of the inventive holder showing a holder in the shape of a pumpkin with a latch and hook closure on the side of the holder.

FIG. 7 is a perspective view of an embodiment of the inventive holder 300 showing a holder 300 in the shape of a pumpkin with an opening on the top. The opening may be on the top, bottom, or side of the holder 300. The framed holder 300 comprises a base frame 320 connected to a lid frame 330 by a hinge (not shown) and a latch closure 340 such as a hook 350 and loop 360 closure, the base frame 320 comprising a first support frame 370 at the bottom of the base connected to a plurality of side support frames 380, the side support frames 380 extending from the first support frame 370 up to a second support frame 390 at the top of the base 320, the second support frame 390 resting against a third support frame 400 forming the base of the lid 330, the third support frame 400 connected to a plurality of top support frames 410, the top support frames 410 extending and bent to meet together at an apex 420 of the framed holder 300 to form the lid 330, the apex 420 having shaped objects 430 attached thereto, wherein the base 320 and the lid 330 of the framed holder 300 may be secured closed when the latch closure 340 is engaged, and wherein the base 320 and the lid 330 of the framed holder 300 may be opened to receive objects therein when the latch closure 340 is released and the hinge (not shown) is bent open.

As shown, the first support frame 370, the second support frame 390, and the third support frame 400 all maintain a circular shape. The first support frame 370, the second support frame 390, and the third support frame 400 may also be of a shape having three or more sides such as a triangle, square, rectangle, trapezoid, or other similar shape. The area defined by second support frame 390 and the area defined by the third support frame 400 may be of the same size, for example, they may have the same circumference.

FIG. 7 also shows the framed holder 300 wherein the area defined by the second support frame 390 and the area defined by the third support frame 400 are of the same size, and the area defined by the second support frame 390 and the area defined by the third support frame 400 are larger in circumference than the area defined by the first support frame 370. In yet another embodiment, the area defined by the second support frame and the area defined by third support frame are of the same size and the area defined by second support frame and the area defined by third support frame are smaller in size than the area defined by the first support frame.

The holder 300 may have objects 430 at the top 420 of the holder 300 may in the shape of one or more leaves. In yet another embodiment, the objects may be in the shape of one or more balls or seeds, shapes having three or more sides, natural objects or whimsical shapes.

The holder may be constructed of metal, plastic, twigs, synthetic material, natural material, and combinations thereof. As shown in FIG. 7, the first support frame 370, the second support frame 390, the third support frame 400, the plurality of side support frames 380, and the plurality of top support frames 410 of the framed vessel 300 may take on the shape of an pumpkin, but may also simulate the shape of an acorn, wreath, orb, canister, other naturally occurring item, or whimsical object. The holder also has decorative items 710 contained within, and may have additional framework 315 woven on and about the holder to decrease the size of the apertures in the holder.

Figure 8:
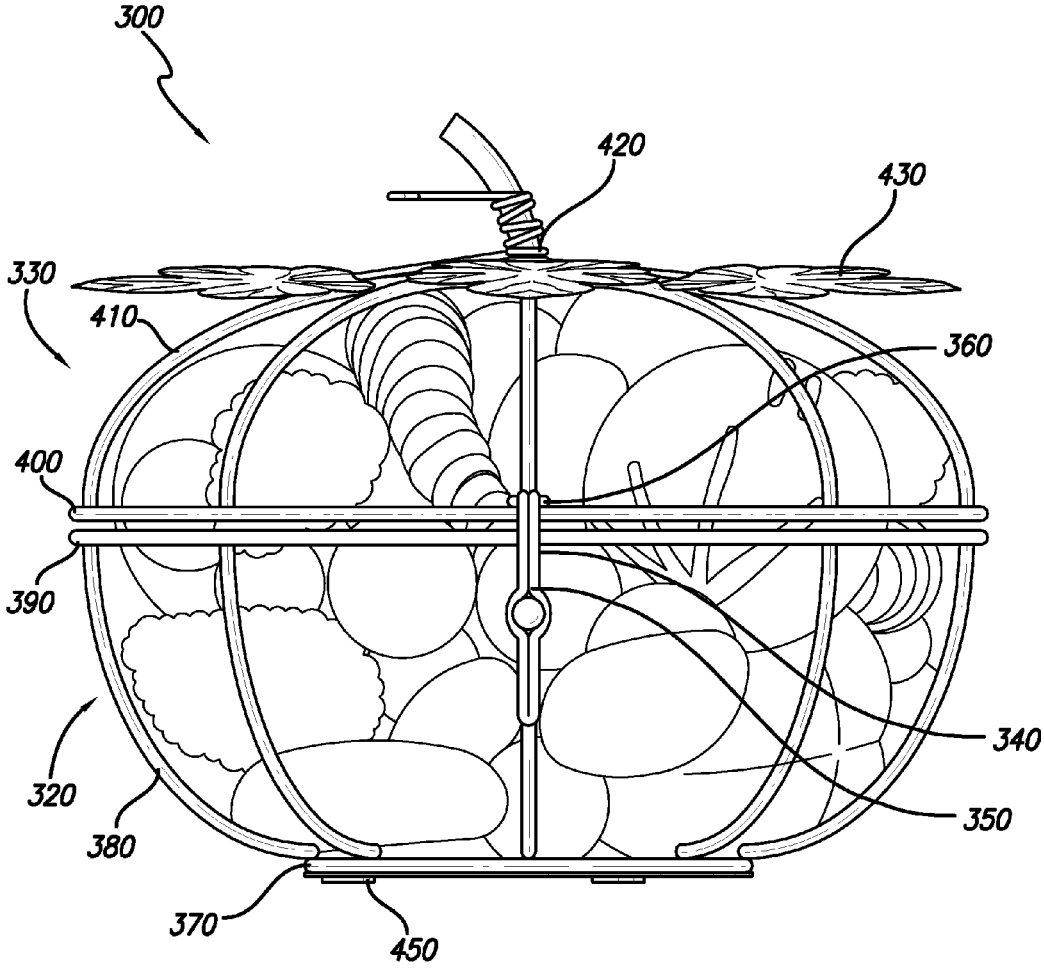
FIG. 8 is a front view of an embodiment of the inventive holder shown in the shape of a pumpkin.

FIG. 8 is a front view of an embodiment of the inventive framed holder 500 shown in the shape of a pumpkin. The framed holder 500 comprises a base frame 520 connected to a lid frame 530 by a hinge (not shown) and a latch closure 540 such as a hook 550 and loop 560 closure, the base frame 520 comprising a first support frame 570 at the bottom of the base connected to a plurality of side support frames 580, the side support frames 580 extending from the first support frame 570 up to a second support frame 590 at the top of the base 520, the second support frame 590 resting against a third support frame 600 forming the base of the lid 530, the third support frame 600 connected to a plurality of top support frames 610, the top support frames 610 extending and bent to meet together at an apex 620 of the framed holder 500 to form the lid 530, the apex 620 having shaped objects 630 attached thereto, wherein the base 520 and the lid 530 of the framed holder 500 may be secured closed when the latch closure 540 is engaged, and wherein the base 520 and the lid 530 of the framed holder 500 may be opened to receive objects therein when the latch closure 540 is released and the hinge (not shown) is bent open. Also, the holder 500 has one or more feet 550.

Figure 9:
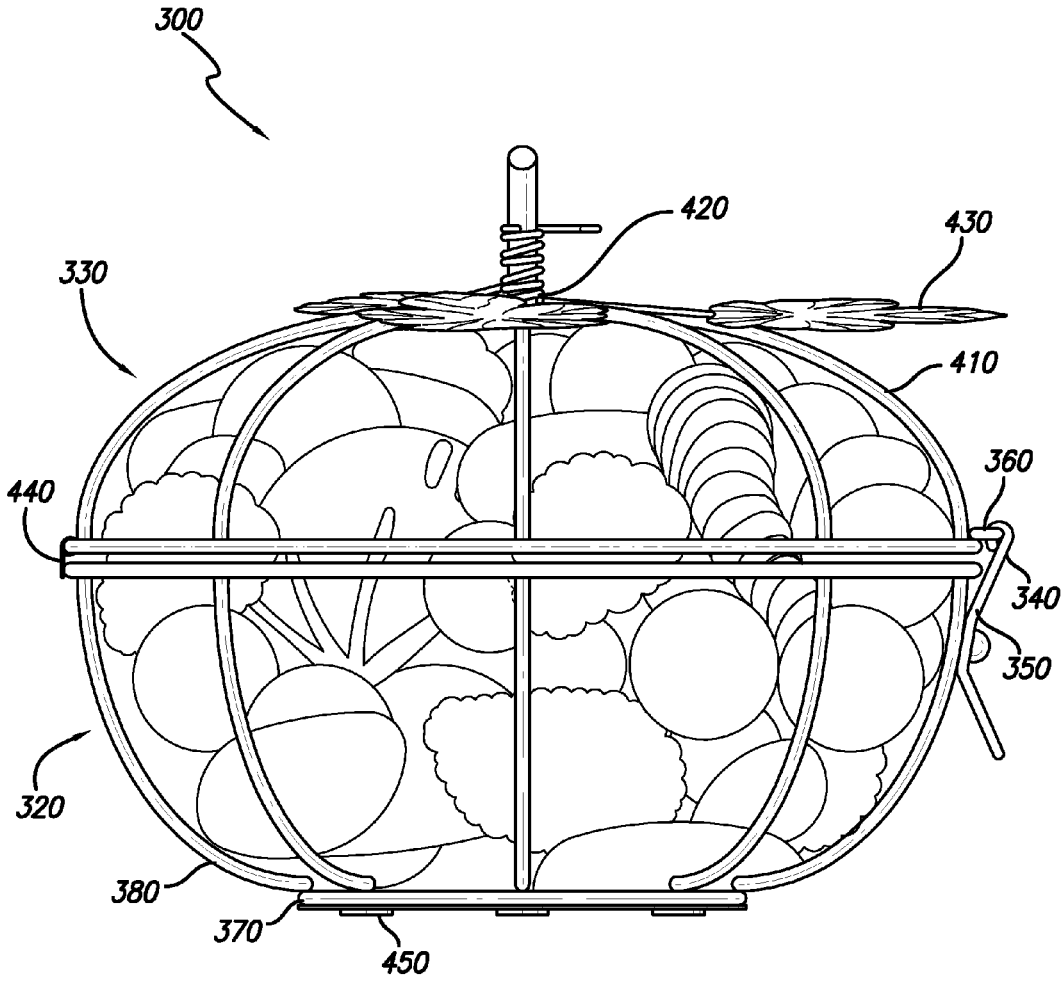
FIG. 9 is a side view of an embodiment of the inventive holder in the shape of a pumpkin.

FIG. 9 is a side view of an embodiment of the inventive framed holder 500 in the shape of a pumpkin showing the hinge 640. The framed holder 500 comprises a base frame 520 connected to a lid frame 530 by a hinge 640 and a latch closure 540 such as a hook 550 and loop 560 closure, the base frame 520 comprising a first support frame 570 at the bottom of the base connected to a plurality of side support frames 580, the side support frames 580 extending from the first support frame 570 up to a second support frame 590 at the top of the base 520, the second support frame 590 resting against a third support frame 600 forming the base of the lid 530, the third support frame 600 connected to a plurality of top support frames 610, the top support frames 610 extending and bent to meet together at an apex 620 of the framed holder 500 to form the lid 530, the apex 620 having shaped objects 630 attached thereto, wherein the base 520 and the lid 530 of the framed holder 500 may be secured closed when the latch closure 540 is engaged, and wherein the base 520 and the lid 530 of the framed holder 500 may be opened to receive objects therein when the latch closure 540 is released and the hinge (not shown) is bent open. Also, the holder 500 has one or more feet 650. The holder 500 also has decorative items 710 and additional framework 700.

Figure 10:
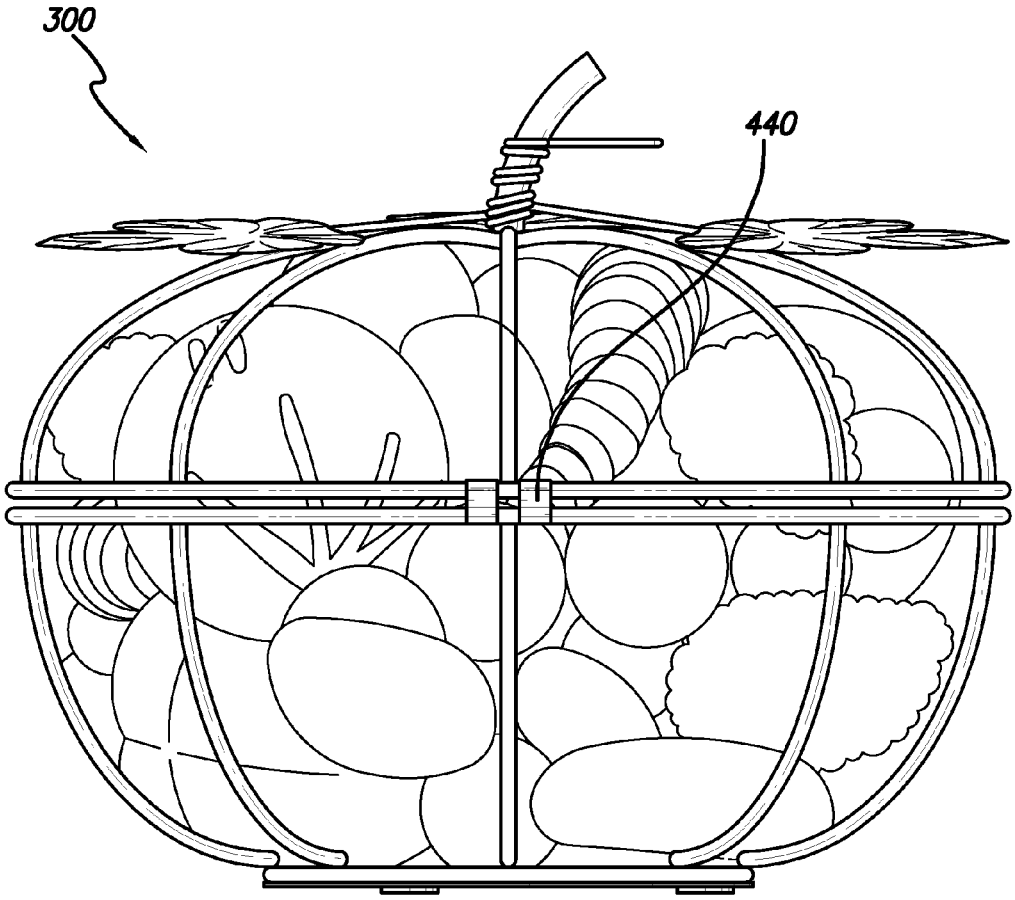
FIG. 10 is a rear view of an embodiment of the inventive holder in the shape of a pumpkin.

FIG. 10 is a rear view of an embodiment of the inventive framed holder 500 in the shape of a pumpkin showing yet another view of the hinge 640.

Figure 11:
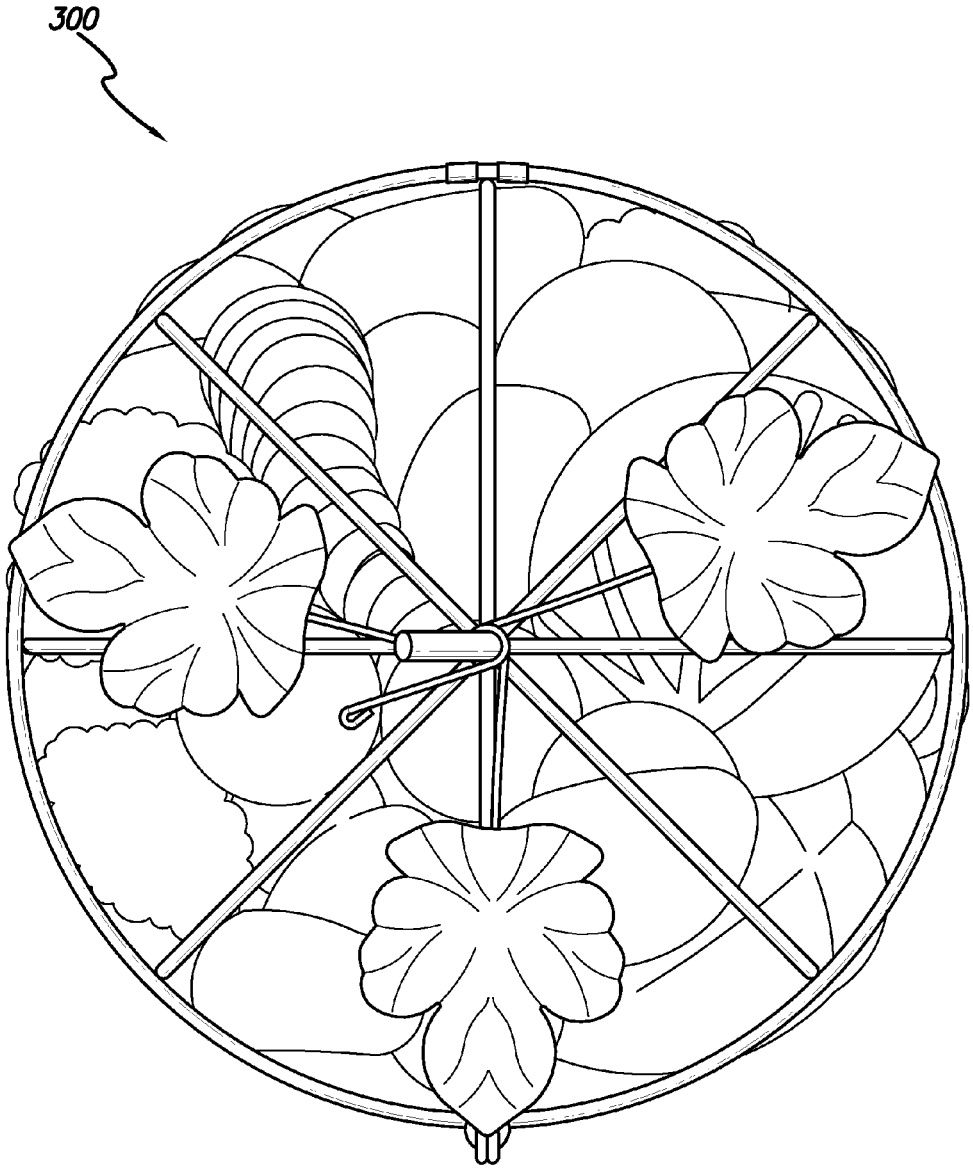
FIG. 11 is a top view of an embodiment of the inventive holder in the shape of a pumpkin.
Figure 12:
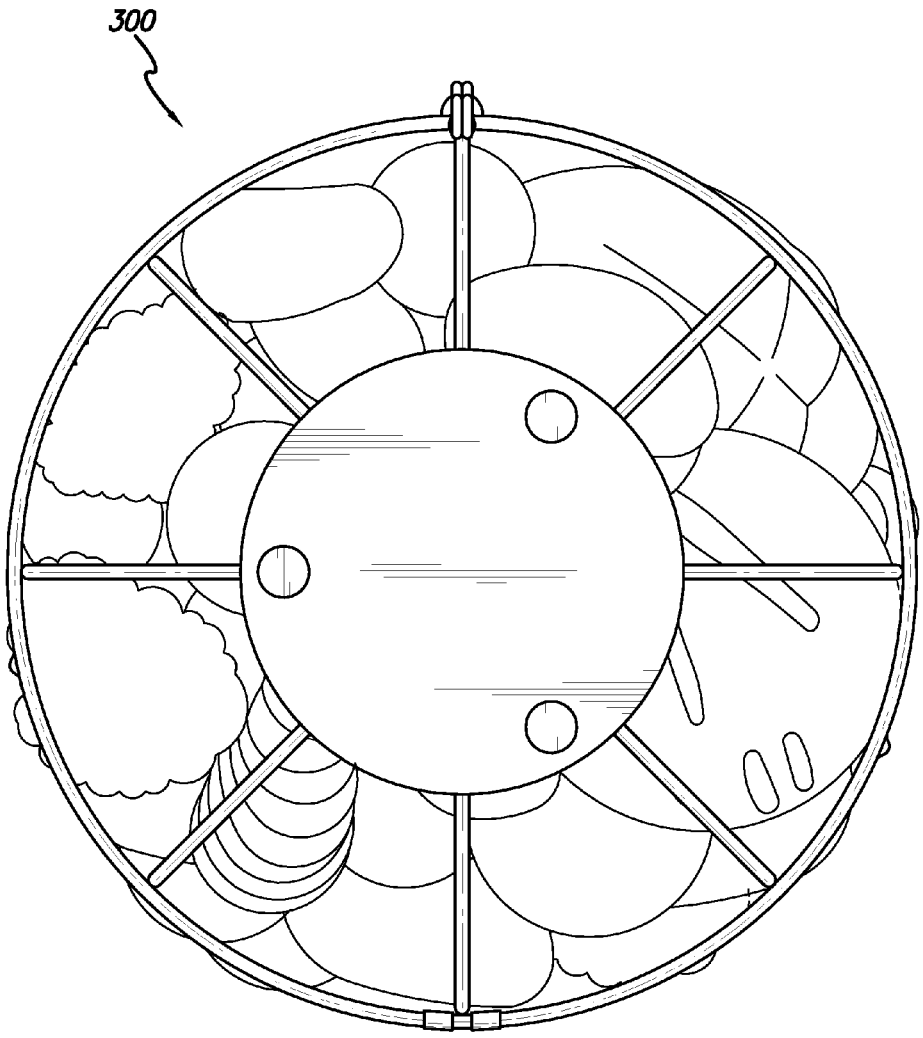
FIG. 12 is a bottom view of an embodiment of the inventive holder in the shape of a pumpkin.

FIG. 11 is a top view of an embodiment of the inventive framed holder 500 in the shape of a pumpkin; and FIG. 12 is a bottom view of an embodiment of the inventive framed holder 300 in the shape of a pumpkin.

Yet another embodiment of the invention includes a method of displaying objects in a framed holder described herein having a lid and a base comprising lifting the lid of the holder, placing objects into the base of the holder, closing the lid of the holder, and securing the lid to the base of the holder. The method may further comprise holding the container with the lid side down when the base of the container defines an area that is smaller than the area defined by the lid, the base being the side that opens or holding the container with the base side down when the base of the container defines an area that is larger than the area defined by the lid, the lid of the container being the side that opens.

While the present invention has been described with regards to particular embodiments, it is recognized that additional variations of the present invention may be devised without departing from the inventive concept.

INDUSTRIAL APPLICABILITY

This invention may be industrially applied to the development, manufacture, and use of containers for holding objects such as potpourri, candy, decorative items, food, and personal belongings.

What is claimed is:

1. A decorative holder for potpourri comprising:

a base frame having a top and a bottom connected to a lid frame having a top and a bottom by a hinge and latch closure, the base frame comprising a first support frame at the bottom of the base frame connected to a plurality of side support frames, the side support frames extending from the first support frame up to a second support frame at the top of the base frame, the second support frame resting against a third support frame forming the bottom of the lid frame, the third support frame connected to a plurality of top support frames, the top support frames extending and interconnected to form the top of the lid frame, the top of the lid frame having shaped objects attached thereto, and potpourri within the holder and held within the base frame, the potpourri being sized so as to be contained within the holder, easily seen within the holder, and of a greater size than any apertures within the holder, wherein the base frame and the lid frame of the decorative holder may be secured closed when the latch closure is engaged, and wherein the base frame and the lid frame of the decorative holder may be opened to receive objects therein when the latch closure is released and the hinge is bent open, and wherein the decorative holder is in the shape of a natural product selected from the group consisting of a fruit, vegetable, nut, tree, animal, sea creature, reptile, and star.

2. The holder of claim 1, wherein the first support frame, the second support frame, and the third support frame all maintain a circular shape.

3. The holder of claim 1, wherein the first support frame, the second support frame, and the third support frame maintain a shape that has three or more sides.

4. The holder of claim 1, wherein the area defined by the second support frame is the same size as and the area defined by the third support frame.

5. The holder of claim 1, wherein the area defined by the second support frame and the area defined by the third support frame are of the same size, and the area defined by the second support frame and the third support frame is larger in size than the area defined by the first support frame.

6. The holder of claim 1, wherein the objects in the shape of one or more leaves are attached to the lid.

7. The holder of claim 1, wherein the holder is constructed of wire.

8. The holder of claim 1, wherein the holder is constructed of wire and twigs.

9. The holder of claim 1, wherein the holder further comprises framework woven on and about the holder to decrease the number and size of apertures.

10. A decorative holder comprising:

a base frame having a top and a bottom connected to a lid frame having a top and a bottom by a hinge and latch closure, the base frame comprising a first support frame at the bottom of the base frame connected to a plurality of side support frames, the side support frames extending from the first support frame up to a second support frame at the top of the base frame, the second support frame resting against a third support frame forming the bottom of the lid frame, the third support frame connected to a plurality of top support frames, the top support frames extending and bent to meet together at an apex of the holder to form the top of the lid frame, the top of the lid frame having shaped objects attached thereto, and decorative items held within the holder, the decorative items sized so as to be contained and seen within the holder and of a greater size than any apertures within the holder, wherein the base frame and the lid frame of the decorative holder may be secured closed when the latch closure is engaged, and wherein the base frame and the lid frame of the decorative holder may be opened to receive objects therein when the latch closure is released and the hinge is bent open.

11. The holder of claim 10, having the shape of an acorn.

12. A decorative holder for holding decorative items comprising:

a base frame connected to a lid frame having a top and a bottom by a hinge and a latch closure, the base frame comprising a first support frame, the first support frame of the base connected to the bottom of the lid frame by the hinge and the latch closure, the bottom of the lid frame comprising a second support frame that rests next to the first support frame of the base, the area defined by the second support frame the same size as the area defined by the first support frame, the second support frame connected to a plurality of side support frames extending from the second support frame up to meet together at a third support frame, the third support frame connected to a plurality of top support frames, the top support frames interconnected to form the top of the lid frame, and decorative items held within the decorative holder, the decorative items sized to be securely contained and visible within the holder, and of a size greater than any aperture in the holder, wherein the base frame and the lid frame of the framed holder may be secured closed when the latch closure is engaged, and wherein the base frame and the lid frame of the framed holder may be opened to receive the decorative items therein when the latch closure is released and the hinge is bent open.

13. The decorative holder of claim 12, wherein the base frame and the lid frame are constructed of metal, plastic, twigs, or a combination thereof.

14. The decorative holder of claim 12, wherein the plurality of side support wires and the top support wires are formed to simulate the shape of a pumpkin.

15. The decorative holder of claim 12, wherein the plurality of side support frames and the top support frames are formed to simulate the shape of an acorn.

16. The decorative holder of claim 12, further comprising decorative objects attached to the lid.

17. The decorative holder of claim 12, wherein the first support frame and the second support frame are circular in shape.

18. The decorative holder of claim 12, wherein the first support frame and the second support frame form a shape having three or more sides.

19. The decorative holder of claim 12, having five or more side support frames and top support frames.

20. The decorative holder of claim 12, wherein decorative items are fragranced botanicals.

* * * * *